US011691836B2

(12) United States Patent
Giurlani et al.

(10) Patent No.: US 11,691,836 B2
(45) Date of Patent: Jul. 4, 2023

(54) REWINDER FOR PRODUCING LOGS OF PAPER MATERIAL

(71) Applicant: FUTURA S.P.A., Capannori (IT)

(72) Inventors: Giovacchino Giurlani, Capannori (IT); Gabriele Betti, Capannori (IT); Manolo Tamagnini, Porcari (IT); Simone Parenti, Lucca (IT)

(73) Assignee: FUTURA S.P.A., Capannori (IT)

( * ) Notice: Subject to any disclaimer, the term of this patent is extended or adjusted under 35 U.S.C. 154(b) by 363 days.

(21) Appl. No.: 17/255,021

(22) PCT Filed: May 29, 2019

(86) PCT No.: PCT/IT2019/050120
§ 371 (c)(1),
(2) Date: Dec. 22, 2020

(87) PCT Pub. No.: WO2020/003328
PCT Pub. Date: Jan. 2, 2020

(65) Prior Publication Data

US 2021/0269268 A1 Sep. 2, 2021

(30) Foreign Application Priority Data

Jun. 25, 2018 (IT) ..... 102018000006604

(51) Int. Cl.
*B65H 18/14* (2006.01)
*B65H 19/22* (2006.01)
*B65H 23/00* (2006.01)

(52) U.S. Cl.
CPC ..... *B65H 18/145* (2013.01); *B65H 19/2269* (2013.01); *B65H 23/005* (2013.01);
(Continued)

(58) Field of Classification Search
CPC ..... B65H 18/14; B65H 18/16; B65H 18/145; B65H 19/2269; B65H 23/005; B65H 2408/235; B65H 2511/14; B65H 2513/10
See application file for complete search history.

(56) References Cited

U.S. PATENT DOCUMENTS 4,487,377 A 12/1984 Perini
5,267,703 A * 12/1993 Biagiotti ..... B65H 18/26 242/541.7

(Continued)

FOREIGN PATENT DOCUMENTS

EP 0 695 712 A1 2/1996
EP 1 700 805 B1 9/2010

OTHER PUBLICATIONS

International Search Report and Written Opinion dated Aug. 22, 2019 in corresponding International Application No. PCT/IT2019/050120; 9 pages.

*Primary Examiner* — Sang K Kim
(74) *Attorney, Agent, or Firm* — Maier & Maier PLLC

(57) ABSTRACT

Rewinder for producing paper logs, comprising a winding station with a first winding roller, a second winding roller and a third winding roller driven by corresponding electric motors, including a detection system capable to detect a succession of diameters of the log being formed in the winding station and a programmable electronic unit connected to the electric motors. The system compares the measured diameters with a succession of corresponding diameters of predetermined value and to calculate a sequence of differences between these values. The electronic unit determines a parameter (a) related to the trend over time of the values. The electronic unit changes the relative speed of the first and second roll depending on the value of the parameter.

6 Claims, 5 Drawing Sheets

(52) U.S. Cl.
CPC .... *B65H 2408/235* (2013.01); *B65H 2511/14* (2013.01); *B65H 2513/10* (2013.01); *B65H 2557/20* (2013.01); *B65H 2701/1924* (2013.01)

(56) References Cited

U.S. PATENT DOCUMENTS

| | | | | |
|---|---|---|---|---|
| 5,853,140 | A * | 12/1998 | Biagiotti | B65H 19/2269 242/534 |
| 7,198,221 | B2 * | 4/2007 | Betti | B65H 19/30 242/534 |
| 7,931,226 | B2 * | 4/2011 | Benvenuti | B65H 19/2269 242/533.3 |
| 9,079,737 | B2 * | 7/2015 | Gelli | B65H 19/2269 |
| 2003/0189123 | A1 * | 10/2003 | Biagiotti | B65H 19/267 242/542.1 |
| 2009/0173819 | A1 * | 7/2009 | Maddaleni | B65H 19/2269 242/527.3 |
| 2009/0272835 | A1 * | 11/2009 | Benvenuti | B65H 19/2269 242/532.2 |
| 2011/0017860 | A1 | 1/2011 | Vaughn et al. | |
| 2013/0020427 | A1 * | 1/2013 | Gelli | B65H 19/2269 242/521 |
| 2015/0034757 | A1 | 2/2015 | Bixler et al. | |
| 2017/0043975 | A1 | 2/2017 | Mellin | |

* cited by examiner

REWINDER FOR PRODUCING LOGS OF PAPER MATERIAL

FIELD

The present invention relates to a rewinder for producing logs of paper material.

BACKGROUND

It is known that the production of paper logs, from which for example rolls of toilet paper or rolls of kitchen paper are obtained, involves the feeding a paper web, formed by one or more superimposed paper plies, on a predetermined path along which various operations are performed before proceeding to the formation of the logs, including a transverse pre-incision of the web to form pre-cut lines which divide it into separable sheets. The formation of logs normally involves the use of cardboard tubes, commonly called "cores" on the surface of which a predetermined amount of glue is distributed to allow the bonding of the paper web on the cores progressively introduced in the machine that produces the logs, commonly called "rewinder", in which winding rollers are arranged which determine the winding of the web on the cores. The glue is distributed on the cores when they pass along a corresponding path comprising a terminal section commonly called "cradle" due to its concave conformation. Furthermore, the formation of the logs implies the use of winding rollers that provoke the rotation of each core around its longitudinal axis thus determining the winding of the web on the same core. The process ends when a predetermined number of sheets is wound on the core, with the gluing of a flap of the last sheet on the underlying one of the roll thus formed (so-called "flap gluing" operation). Upon reaching the predetermined number of sheets wound on the core, the last sheet of the log being completed is separated from the first sheet of the subsequent log, for example by means of a jet of compressed air directed towards a corresponding pre-cutting line. At this point, the log is unloaded from the rewinder. EP1700805 discloses a rewinding machine which operates according to the above-described operating scheme. The logs thus produced are then conveyed to a buffer magazine which supplies one or more cutting-off machines by means of which the transversal cutting of the logs is carried out to obtain the rolls in the desired length.

SUMMARY

The present invention relates specifically to checking the diameter of the logs inside the rewinders and it is intended to provide a control system for the automatic adjustment of the speed of the winding rollers according to the actual diameter of the logs to compensate for any possible error due, for example, to the surface wearing of the winding rollers and/or to the presence of debris on the surface of the winding rollers and/or to the surface characteristics of the paper. In other words, the present invention allows to automatically adjust the so-called "return", that is, a parameter that indicates the speed difference between two winding rollers that determines the growth of the logs in formation, on the basis of the comparison of the measured diameters actual diameters of the logs with corresponding predetermined values. This result has been achieved, in accordance with the present invention, by providing a rewinder having the characteristics indicated in claim 1. Other features of the present invention are the object of the dependent claims.

Among the advantages offered by the present invention, the following are mentioned for example: the control of the rewinder is constant over time and does not depend on the experience of the people in charge of driving the machines; it is possible to use commercially available optical devices; the cost of the control system is very low in relation to the advantages offered.

BRIEF DESCRIPTION OF THE DRAWINGS

These and further advantages and features of the present invention will be more and better understood by every technician in the field thanks to the following description and the attached drawings, provided as an example but not to be considered in a limiting sense, in which.

DETAILED DESCRIPTION OF THE EMBODIMENTS

Figure 1:
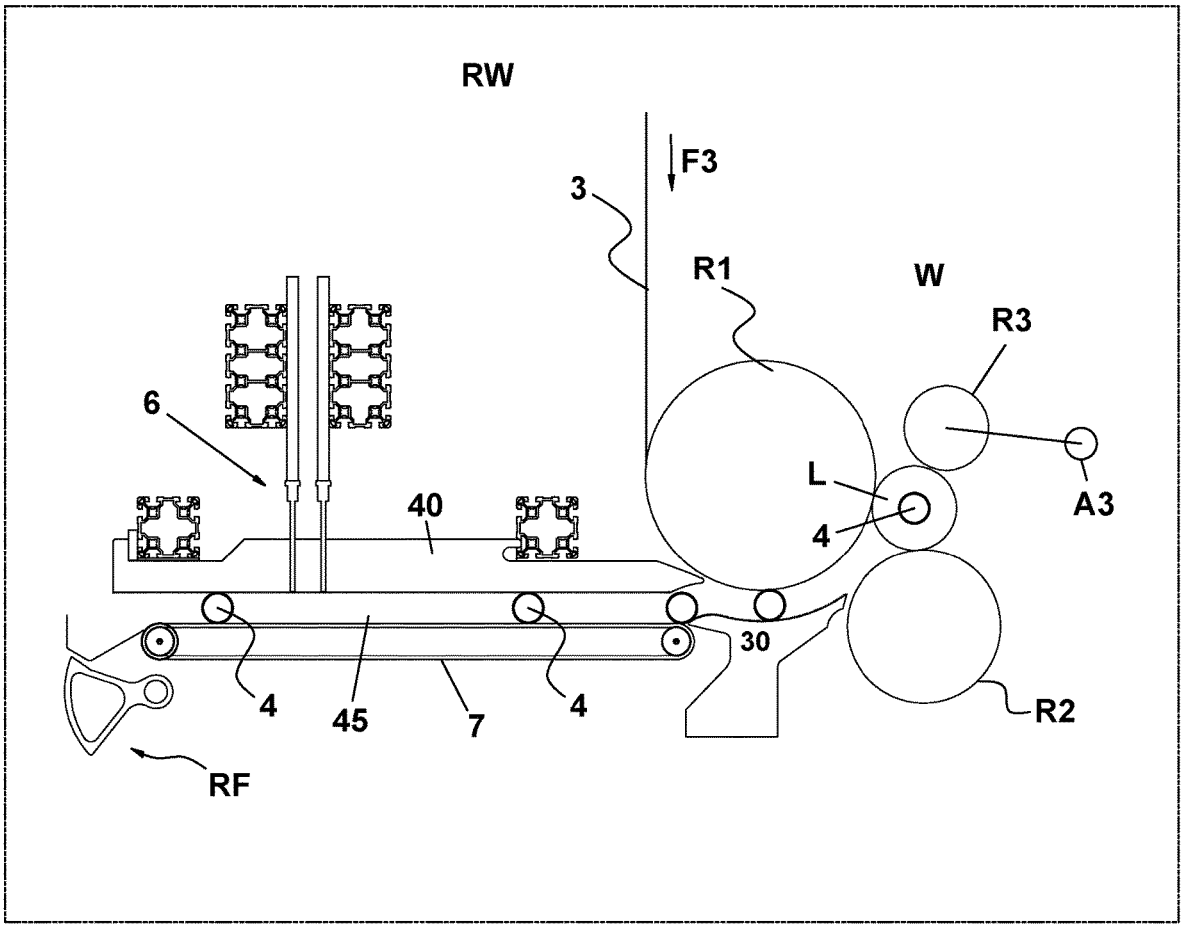
FIG. 1 shows a schematic side view of a rewinder for the production of logs of paper material with a log (L) being formed.
Figure 2:
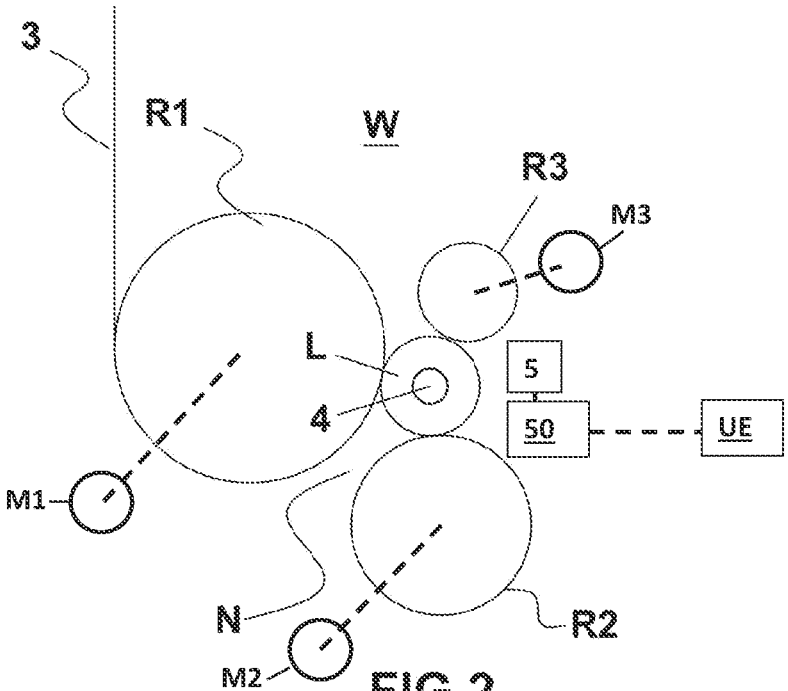
FIG. 2 represents a detail of FIG. 1.

A control system according to the present invention is applicable, for example, to the control of the operation of a rewinder (RW) of the type shown in FIG. 1 and FIG. 2. The rewinder comprises a paper winding station (W) with a first winding roller (R1) and a second winding roller (R2) able to delimit, with the respective external surfaces, a nip (N) through which is fed a paper web (3) formed by one or more paper plies that is intended to be wrapped around a tubular core (4) to form a paper log (L). The web (3) is provided with a series of transverse incisions which divide the web into consecutive sheets and facilitate the separation of the individual sheets. Each paper log (4) is formed by a predetermined number of sheets wrapped around the core (4). During the formation of the log, the diameter of the latter increases up to a maximum value which corresponds to a predetermined length of the web (3), or to a predetermined number of sheets. In the winding station (W) a third winding roller (R3) is arranged which, with respect to the direction (F3) followed by the web (3), is arranged downstream of the first two winding rollers (R1, R2). Furthermore, the second winding roller (R2) is placed at a lower level than the first winding roller (R1). According to the example shown in the drawings, the axes of rotation of the first roller (R1), of the second roller (R2) and of the third roller (R3) are horizontal and parallel to each other, i.e. oriented transversely with respect to the direction of origin of the tape (3). The third roller (R3) is connected to an actuator (A3) which allows it to be moved from and to the second roller (R2), that is, it allows it to be moved from and towards the aforementioned nip (N). Each of said rollers (R1, R2, R3) rotates around its own axis being connected to a respective motor (M1, M2, M3). The cores (4) are introduced sequentially into the nip (N) by means of a conveyor which, in the example shown in FIG. 1 comprises motorized belts (7) arranged underneath fixed plates (40) that, in cooperation with the belts (7), force the cores (4) to move rolling along a straight path (45). The latter is comprised between a section for feeding the cores, where an introducer (RF) is arranged, and a cradle (30) arranged below the first winding roller (R1). In correspondence with said path (45), nozzles (6) are provided by means of which glue is applied to each core (4) to allow the adhesion of the first sheet of each new log on the core itself and the gluing of the last sheet of the log on the underlying sheets. The operation of a rewinder of the type described above is known per se.

It is understood that, for the purposes of the present invention, the system for feeding the cores (4) to the winding station (W), as well as the methods and means of dispensing the glue onto the cores (4), can be realized in any other way.

The motors (M1, M2, M3) and the actuator (A3) are controlled by a programmable electronic unit (UE) that is further described below.

According to the present invention, for example, an optical vision system is provided, comprising a camera (5) adapted to take one end of the log being formed. The image of the end of each log (L) detected by the camera (5) therefore corresponds to a two-dimensional shape whose edge is detected by discontinuity analysis of the luminous intensity using so-called "edge-detection" algorithms. These algorithms are based on the principle that the edge of an image can be considered as the boundary between two dissimilar regions and essentially the contour of an object corresponds to a sudden change in the levels of luminous intensity. Experimental tests were conducted by the applicant using an OMRON FHSM 02 camera with OMRON FH L 550 controller. The camera (5) is connected to a programmable electronic unit (UE) which receives the signals produced by the same camera. The latter provides the programmable unit (UE) with the diameter of the log. In this example, the controller (50) is programmed to calculate the equation of a circumference passing through three points (H) of the detected edge (EL) as previously mentioned and to calculate its diameter. In practice, the identification of the three points (H) arranged on the outer circumference of the log being formed determines the achievement of the value of the corresponding diameter.

Figure 4:
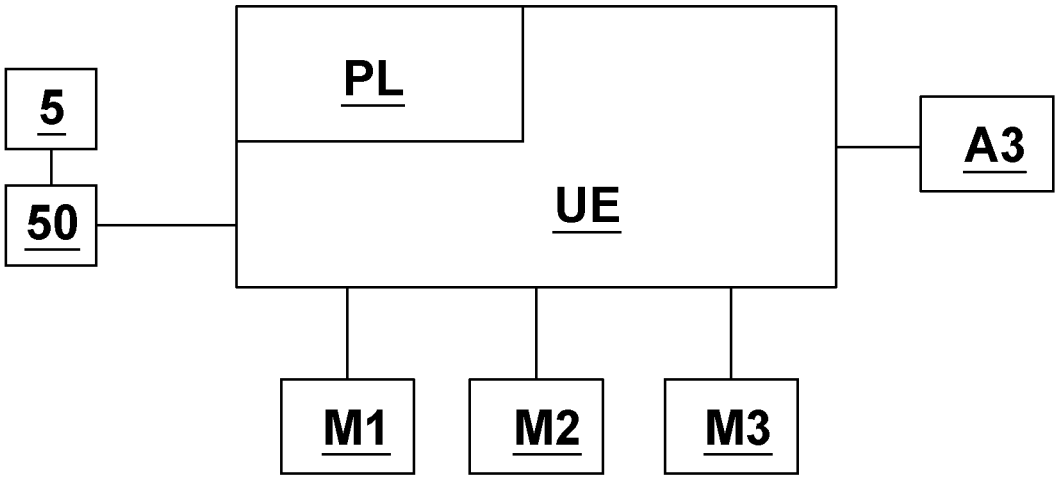
FIG. 4 is a simplified block diagram related to the programmable electronic unit (UE) shown in FIG. 2.

The camera (5) is operated by the unit (UE) for a predetermined number of times in a predetermined time interval to obtain corresponding values for the diameter of the log being formed. In other words, the camera (5) performs a plurality of detections during the formation of the log (L), with a distribution of these detections over time which may not be constant. In fact, it has been verified that an optimal detection can be realized by carrying out a considerable part of detections in the initial part of the formation of the log; for example, the inventors believe that it is more effective to perform about 70% of the detections in the initial part of the winding, corresponding to substantially 30% of the entire winding cycle, and the remaining part of the measurements (about 30%) in the remaining 70% of the winding cycle. In practice, during the formation of the log (L) the camera (5) performs a series of detections which determine a corresponding series of values of the actual diameter (DE) of the log being formed. The processing unit (UE), which can include a PLC control system (marked by the block PL in FIG. 4), compares the values obtained from the readings (DE) with the corresponding preset values (DT) that the log should exhibit at the corresponding winding phases. In practice, the system compares the succession of the values of the actual measured diameters (DE) with the corresponding sequence of theoretical reference diameters (DT). These data are processed for the automatic adjustment of the so-called "return" mentioned above, i.e. to automatically determine how the speed of the lower roller (R2) must be changed with respect to the speed of the upper roller (R1), both motors (M1, M2) of the rollers (R1, R2) being controlled by said processing unit (UE).

Figure 6:
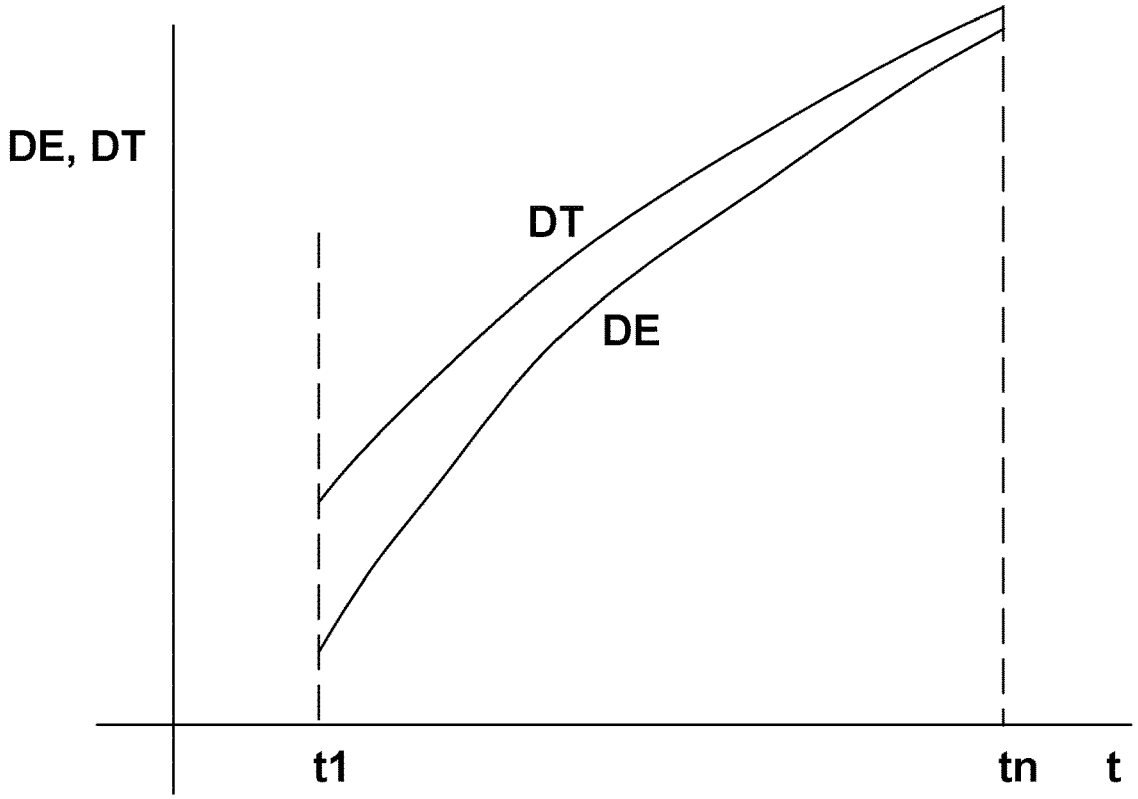
FIG. 6 is a scheme illustrating the measuring of the diameter in accordance with the invention.

In practice, during the phase of growth of the log (L), i.e. during the formation of the log in correspondence of the the rollers of the winding station (W), the camera (5) carries out a succession of detections at preset times. For each photo (i.e. for each detection of the three points H indicated in the drawings), the value of the actual diameter (DE) is determined, and this value is compared, for each detection, with a corresponding reference value or theoretical diameter (DT) which is memorized by the processing unit (UE) or the control unit (PL). The processing unit (UE), based on the comparison between the actual diameters (DE) and the corresponding theoretical diameters (DT), determines, for each detection and each comparison, the error related to the diameter over time, i.e. during the winding of the log. FIG. 6 shows two curves which qualitatively show a possible trend of the diameter over time in relation to the actual value (DE) and the predetermined theoretical value (DT). In this example, it is assumed that the error progressively decreases during the winding cycle.

Figure 3A:
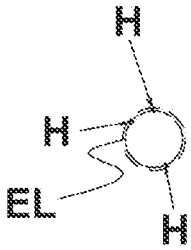
FIG. 3A schematically represents a log in formation seen from an end in different winding stages.
Figure 3B:
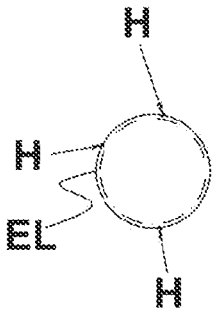
FIG. 3B schematically represents a log in formation seen from an end in different winding stages.
Figure 3C:
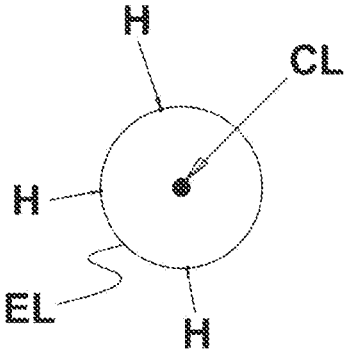
FIG. 3C schematically represents a log in formation seen from an end in different winding stages.

The diagrams in FIGS. 3A-C represent three possible situations of error detection in three different times. In FIG. 3A the diameter measured based on the position of the points (H) is smaller than the theoretical one (circumference in dotted line); in FIG. 3B the detected diameter is greater than the theoretical one; in FIG. 3C the detected diameter coincides with the theoretical one. In the drawings the reference (CL) indicates the center of the log.

Figure 5:
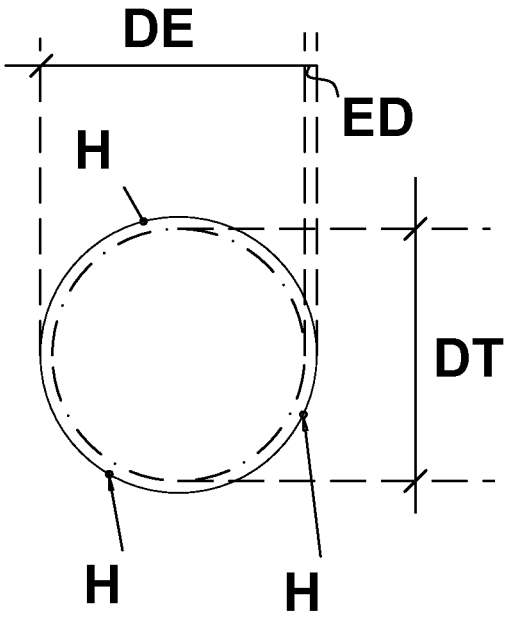
FIG. 5 is a diagram relating a possible control performed in a rewinder according to the present invention.

In FIG. 5 the reference (ED) represents the difference between the two above mentioned diameters (DT, DE).

Figure 7A:
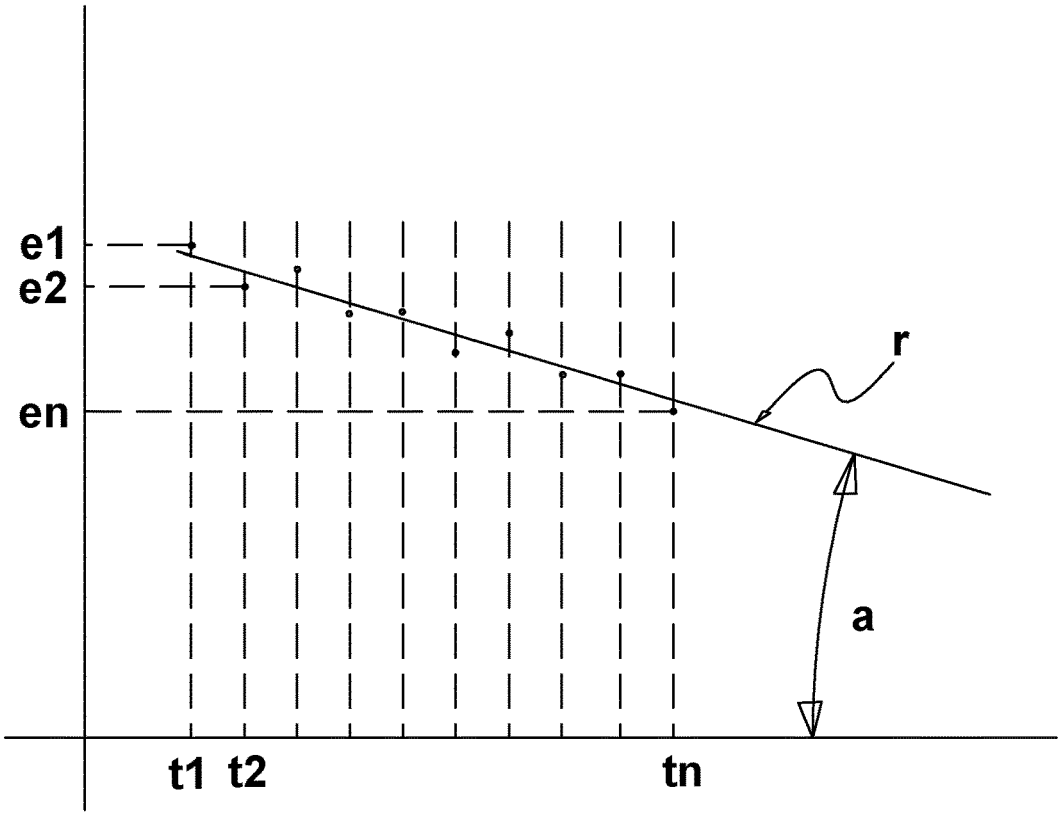
FIG. 7A is a scheme illustrating the measuring of the diameter in accordance with the invention.
Figure 7B:
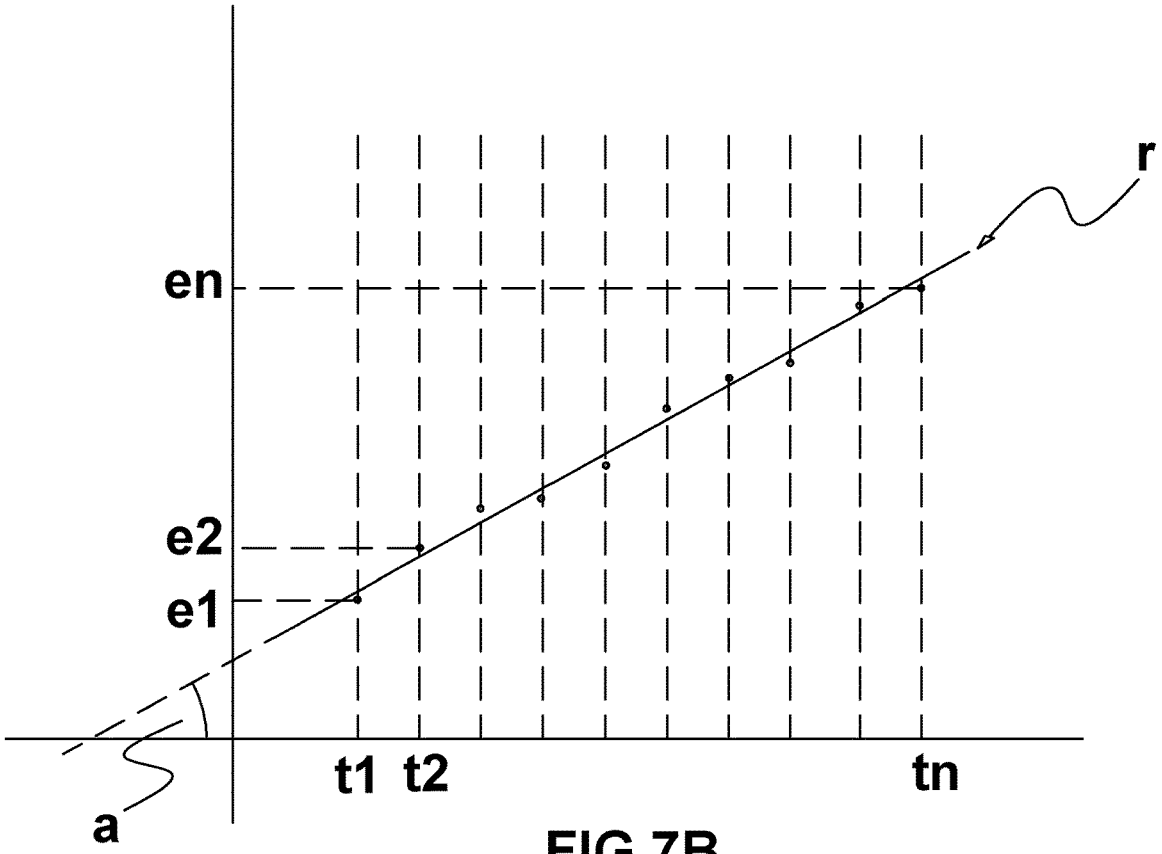
FIG. 7B is a scheme illustrating the measuring of the diameter in accordance with the invention.
Figure 7C:
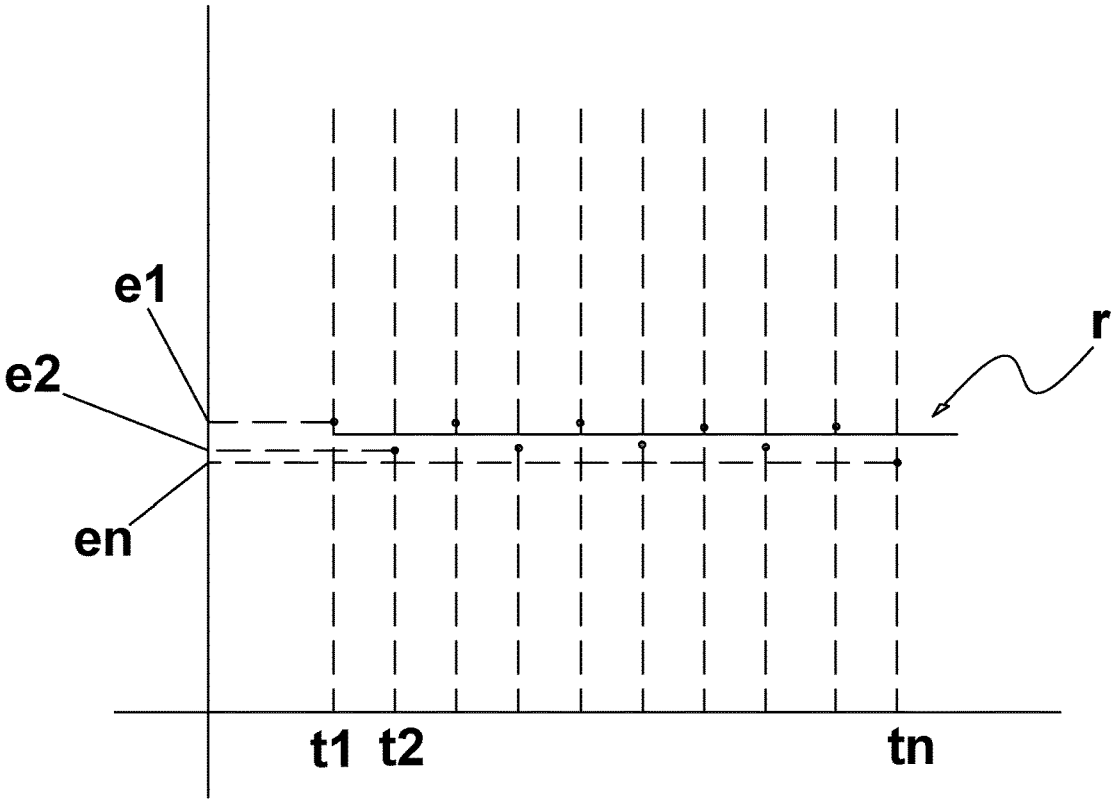
FIG. 7C is a scheme illustrating the measuring of the diameter in accordance with the invention.

FIGS. 7A, 7B and 7C represent three possible trends of the errors (e1, e2, . . . , en) of diameter detected in a succession of instants (t1, t2, . . . , tn), where in each time of detection the error is given by the difference between the detected diameter (DE) and the theoretical diameter (DT) and the straight line (r) is a straight line whose equation is determined by the unit (UE) applying, for example, the least squares method to the set of values (e1, e2, . . . , en). In any case, a linear correlation is established between said values (e1, e2, . . . , en) that is apt to indicate the temporal progression of the errors (e1, e2, . . . , en), correlation that allows to establish whether the errors decrease, increase or remain constant over time as schematically shown in FIGS. 7A, 7B and 7C.

The times in which the measurements are performed have been shown equally spaced in the graphs of FIGS. 7A, 7B and 7C to simplify the drawings but, as previously mentioned, most of the detections are preferably performed in the initial part of the winding. The aforementioned trend is represented by the slope (a) of the straight line (r) with respect to the time axis.

In practice, if the errors (e1, e2, . . . , en) tend to decrease, the line (r) has a negative slope (a), as schematically illustrated in FIG. 7A.

If the errors (e1, e2, . . . , en) tend to increase, the line (r) has a positive slope (a), as schematically illustrated in FIG. 7B.

Finally, if the errors (e1, e2, . . . , en) are of substantially constant value, the line (r) has a substantially zero slope (a), as schematically illustrated in FIG. 7C.

Depending on the slope (a) of the straight line (r) the processing unit (UE) can determine a corresponding correction of the return.

For example, for values of (a) smaller than zero (as in FIG. 7A) the processing unit (UE) performs the so-called increase of the return, i.e. it drives a decrease in the speed of rotation of the roller (R2) with respect to the roller (R1).

For values of (a) greater than zero (as in FIG. 7B) the processing unit (UE) performs decrease of the return, i.e. it drives an increase in the speed of rotation of the roller (R2) with respect to the roller (R1).

For values of (a) substantially equal to zero (as in FIG. 7C), for example for values between −0.1 and +0.1, the processing unit (UE) does not perform any correction.

The aforementioned value (a) represents, in more general terms, a parameter related to the trend over time of the values (e1, e2, . . . , en) that form said succession of differences. According to the example described above in which (a) is the slope of the straight line (r), the processing unit (UE) modifies the relative speed of said first and second roll (R1, R2) when this parameter is external to a predetermined range of values containing the zero value. The possible correction is driven after the completion of the log wrapping cycle and therefore will affect the logs subsequently formed in the winding station of the rewinder.

The processing unit (UE) can be provided with display means for displaying, for example, the values of the actual diameters detected, the values of the errors with respect to theoretical reference values, the trend of the errors over time, and the possible variations of the lower roller speed in relation to the speed of the upper roller. The same processing unit (UE) can comprise signaling means suitable for alerting the operators when the value of (a) is constantly equal to zero.

In practice, the details of execution can in any case vary in an equivalent manner as regards the individual elements described and illustrated and their mutual arrangement without departing from the scope of the idea of solution adopted and therefore remaining within the limits of the protection conferred by the present patent as defined by the claims.

The invention claimed is:

1. A rewinder for the production of logs of paper material, comprising a winding station for winding the paper with a first winding roller and a second winding roller, the first winding roller and second winding roller delimiting, with their respective external surfaces, a nip through which a paper web comprising one or more paper plies is fed and intended to be wound in said station to form a log, and a third winding roller which, in relation to a direction from which the web is fed, is positioned downstream of the first two winding rollers, wherein the second winding roller is positioned at a lower level than the first winding roller, wherein the axes of rotation of the first winding roller, second winding roller and third winding roller are horizontal and parallel to each other, such that they are oriented transversely to the direction from which the web is fed, wherein the third winding roller is connected to an actuator which allows it to be moved cyclically from and to the nip so that the position of the winding third roller varies in relation to the other two winding rollers during the production of the logs, wherein each of the said winding rollers rotates around its own axis being connected to a corresponding electric motor, wherein the rewinder further comprises a detection system with an optical vision system capable to detect, in a succession of predetermined detection times, a succession of diameters assumed in such times by a log being formed in the winding station and a programmable electronic unit connected to said electric motors and to said optical vision system, wherein the programmable electronic unit is programmed to compare the measured diameters by the optical vision system with a succession of corresponding diameters of predetermined value and to calculate a sequence of differences between these values, wherein said programmable electronic unit determines a parameter related to the trend over time of the values which form said sequence of differences, and wherein said programmable electronic unit changes the relative speed of said first and second roll depending on the value of said parameter.

2. The rewinder according to claim 1, wherein said parameter is the slope of a line for correlating the values of said sequence of differences with respect to time.

3. The rewinder according to claim 2, wherein the processing unit modifies the relative speed of said first and second roll when the value of said slope is outside a predetermined range of values, within which range the null value is contained.

4. The rewinder according to claim 1, wherein each diameter of the succession of diameters detected by the optical vision system is determined by the detection system upon detection of three points of a succession of images of the edge of one end of the log detected by said optical vision system in said sequence of detection instants.

5. The rewinder according to claim 1, wherein the processing unit is provided with display means by which one or more of the following are represented: the values of the actual measured diameters, the values of errors with respect to theoretical reference values, the trend of errors over time, any variations determined in the speed of the lower roll compared to the upper one.

6. The rewinder according to claim 1, further comprising a device for feeding cores for log formation, the device being adapted to sequentially introduce cores into said nip.

* * * * *